United States Patent [19]

Peillon et al.

[11] Patent Number: 4,729,494

[45] Date of Patent: Mar. 8, 1988

[54] CONTAINER FOR LIQUID GAS

[76] Inventors: Jean-Pierre Peillon; Daniel Demilliere; Bruno Moglia; Pierre Barrellon, all of Application Des Gaz Box No. 1, 69230 St Genis Laval, France

[21] Appl. No.: 848,688

[22] Filed: Apr. 4, 1986

[30] Foreign Application Priority Data

Apr. 12, 1985 [FR] France ..... 85 05747

[51] Int. Cl.[4] ..... B67B 7/24

[52] U.S. Cl. ..... 222/3; 222/5; 62/50; 206/0.7

[58] Field of Search ..... 222/3, 5, 189, 464, 222/407.1, 394; 431/150, 130, 142; 206/0.6, 0.7; 62/48, 50, 52

[56] References Cited

U.S. PATENT DOCUMENTS

| | | | |
|---|---|---|---|
| 996,969 | 7/1911 | Buckman | 222/3 |
| 1,080,263 | 12/1913 | Coleman | 222/3 |
| 2,036,710 | 4/1936 | Mapes | 222/5 |
| 2,465,643 | 3/1949 | Goss | 158/27.6 |
| 2,535,452 | 12/1950 | Quercia et al. | 62/48 |
| 2,549,255 | 4/1951 | Srowder | 222/5 |
| 2,662,379 | 12/1953 | Reich | 222/3 |
| 2,710,533 | 6/1955 | Fischer et al. | 431/130 |
| 2,733,842 | 2/1956 | Abplanalp | 222/402.1 |
| 3,118,288 | 1/1964 | Small | 222/5 |
| 3,146,923 | 9/1964 | Chappell | 222/464 |
| 3,260,421 | 7/1966 | Rabussier | 222/464 |
| 3,917,115 | 11/1975 | Travers et al. | 222/3 |

FOREIGN PATENT DOCUMENTS

| | | |
|---|---|---|
| 897877 | 4/1945 | France . |
| 654045 | 6/1951 | United Kingdom . |
| 677303 | 8/1952 | United Kingdom . |
| 1010986 | 11/1965 | United Kingdom . |

OTHER PUBLICATIONS

O. Roehrich, *La Fibre de Coton,* Editions de l'Industrie Textile, pp. 16–22 and 37–38 (1948).

*Primary Examiner*—H. Grant Skaggs
*Attorney, Agent, or Firm*—Lee C. Robinson, Jr.

[57] ABSTRACT

Container (1,12) intended to contain at least one liquid gas in both liquid and gaseous phase, comprised at least of a body (2), an absorbing material plug (9) inserted in said body and having at least one bore (9a) extending along one dimension (for instance the height) of the container, and a gaseous phase bleeding area being provided adjacent to the bore. A feeding tube (6) is fitted inside the bore (9a), has a free end located inside said bore and free of any contact with the plug (9), and communicates by its other end, tightly with respect to the inside of the container with a bleeding device (5) working only in gaseous phase and located in said bleeding area.

25 Claims, 4 Drawing Figures

CONTAINER FOR LIQUID GAS

The present invention concerns containers intended for containing or storing a liquid gas.

"Liquid gas" means any body or fluid whatever presenting under the storing conditions (namely pressure and temperature) two different phases, liquid and gaseous, normally separated by an interface. It can be a liquified gas, i.e. a body of which the liquid phase is in equilibrium with its vapour phase, the gas pressure inside the container being then equal to the vapour pressure of said body; among the liquified gases we find first of all the liquified petroleum gases (LPG), for instance butane, to which the explanations given about the invention will refer. It can also be a dissolved gas, i.e. a body of which the gaseous phase is in equilibrium with a phase dissolved in an appropriate solvent, the latter forming the liquid phase mentioned above. In a general way, "body" means either a pure body or a blend of pure bodies; as a matter of fact, the so-called trade butane appears to be a blend of butane and some other hydrocarbons.

Regarding the storing conditions, the liquid gas stored in the container can be pressurized or not, the internal pressure inside the container being either lower, higher than or equal to the room or external pressure, for instance the atmospheric pressure. In the same way, the temperature of the liquid gas can be or not lower than, or equal to, the room temperature; the containers according to the invention can serve as cryogenic storing containers, i.e. intended to store liquified gases at very low temperatures, for instance liquid nitrogen.

The containers covered by the present invention can have different shapes, particularly as determined by the particular applications.

(1) They can be fixed or mobile, portable or not, of small or big size.

(2) When portable, they may be reloadable, or of the throw away-type, i.e. used only once.

(3) When of the throw away type, the containers according to the invention may be as well pierceable containers, called "cartridges" in the practice, as containers fitted with a particular bleeding device of the gaseous phase, such as a tap or a valve.

(4) When of the throw-away type and equipped with a valve, the containers according to the invention are mostly aerosol generators, in which the liquid gas acts as a transport agent for some other divided body, solid or liquid, contained or not in the same container.

(5) Also, the containers according to the invention can be or not integrated or built-in in equipment consuming in some way liquid gas under gaseous form; in such cases, as for instance for burners fed by the liquid phase of a liquified petroleum gas, a container according to the invention may be a tank integrated in the equipment, reloadable with commercial butane bleeding from a cartridge.

The present invention covers containers such as defined above, able to supply the liquid gas they contain in the form of its gaseous phase, and only in this form. In most gaseous phase applications, the unwanted bleeding of liquid phase due to a number of different causes can induce various inconveniences and even create danger. Considering for instance a soldering lamp equipped with a gas burner, the lamp must be held vertical on starting the operation, in order to make sure that the gas bleeds only in gaseous phase, i.e. from the gas chamber of the cartridge. Any movement, for instance tilting, of the cartridge causes bleeding of liquid phase droplets, and direct combustion of liquid in the burner. Since the burner is designed to work on gas, the introduction of liquid results immediately in long lazy yellow flames produced by combustion without secondary air; in some domestic equipments for instance, the occurrence of such flames may be quite dangerous.

In order to retain the liquid phase of the gas, and to feed only gaseous phase, "trapping" the liquid phase in an absorbing material placed inside the container has been known for a very long time. In the whole present description as well as in the claims, "absorbing material" means a material presenting an apparent volume much more important than its actual volume and having consequently a very large developed area, both internally and externally, to retain the liquid phase of the liquid gas by superficial tension. Such material contains of course a high proportion of voids. It can be a porous or fibrous material, or a material having any other shape, consistency or structure, provided it meets the above mentioned general definition, whatever be its kind, natural, mineral, organic, synthetic, and so on.

According to the British Pat. No. 677 303, a liquid gas container has already been proposed, which is produced in the following manner.

The process starts from an absorbing material plug, in this case a porous material such as active coal, presenting a blind boring extending along one dimension, namely the height.

A gas and liquid tight wall forming the container body is then built by spraying lacquer or resin around the plug.

The liquid gas is bled in gaseous form through an opening in the wall, made of a tube connected to the open end of the boring.

In the case of liquified petroleum gases, different absorbing materials have been proposed:

(a) According to the documents FR-A-897 877 and GB-A-654 045, a cotton packing has been proposed, i.e. a fibrous type natural material with hollow fibers (see pages 17 and fol. of O. ROEHRICH's work "La fibre de coton", published by the Editions de l—Industrie Textile in 1948).

(b) According to the document GB-A-1,010,986 concerning particularly a reloadable tank for lighters, a complete filling up of said tank with plastic foam has been proposed, namely polyurethane formed on the spot.

Depending on the shape and dimensions of the container, another means proposed in order to evacuate the liquid gas in gaseous form comprises a device for adjusting the quantity of liquid gas introduced in the container as a function of the position of the free end of a feeding tube plunging inside and along the axis of the container and connected to a bleeding device. In this way and according to the patent U.S. Pat. No. 2,465,643 covering a soldering lamp with a cylindrical tank, the feeding tube plunges down to half the height of the tank, the latter being only half filled, so that the gas-liquid interface lies flush with or below the free end of the feeding tube, whatever be the position of the soldering lamp.

Independently of the storing and/or bleeding mode of the liquid gas, each of the above considered solutions leads, for a container of a given capacity, to the storage of a limited quantity of liquid gas, and in any case of a quantity well below the available capacity of the container.

An example pertaining to the field of the commercial butane throw away valve cartridges will help to better understand what is stated above.

Let us consider a valve cartridge with a diameter of 40 mm and a height of 125 mm, and consequently a container higher than broad. Taking the room needed for the valve into account, the maximum useful volume is 135 $cm^3$. According to the French rules (see Règlement de Transport des Matières Dangereuses, Rules governing the Transport of Dangerous Materials, article 30.1, paragraph 5, published in the Official Journal of the 18/09/61) and for safety's sake, a certain part of this useful volume must be employed for the gaseous phase (at least 5% at 50° C.) and consequently the maximum volume available for the liquid phase is 124.5 $cm^3$; based on the specific weight of commercial butane at 50° C., i.e. 0.513 kg/l, this represents a maximum butane load of 63.84 g, hereafter called $m_o$.

Let us assume that this cartridge has been realized according to the American U.S. Pat. No. 2,465,643, which means that it contains a feeding tube plunging down to mid height of the container. In this case, the maximum volume that can be used for the liquid phase is 67.5 $cm^3$, the feeding tube itself being neglected, which represents, in function of the specific weight of commercial butane at 50° C., a maximum butane load equal to 34.69, or 54% of $m_o$.

Let us now imagine that the same cartridge has been produced according to the British Pat. No. 677,303, including a cellulose fiber plug of the paper paste type having the form of a cylinder with an axial bore and extending along the total length of the container.

Neglecting the axial bore and assuming that the real and apparent densities of the cellulose fibers used are respectively of 1.5 $g/cm^3$ and 0.11 $g/cm^3$, the available maximum useful volume is of 121.4 $cm^3$. Taking the same rules as above into account, the maximum volume that can be used for the liquid phase of the commercial butane is 115.3 $cm^3$, which corresponds at 50° C. to a maximum butane load of 59.16 g, hereafter called $m_1$, representing about 93% of $m_o$.

Consequently, with a cellulose fiber packing absorbing theoretically the whole liquid phase of the gas introduced into the cartridge, it is possible to obtain a butane load very close to that of the cartridge without packing, without any risk of feeding liquid phase when the cartridge is bleeding in gaseous phase.

In this particular case as in the case of containers of similar geometry, practice has produced results that are far from theory. With a bore having a diameter of 6 mm, and according to the test procedure defined below, the load that may be introduced safely without any risk of bleeding the liquid phase is equal to 48 g, which represents 81% of the theoretical load $m_1$, or 75% of the load without packing $m_o$.

For containers equipped with absorbing material, the present invention strives to increase the load of liquid phase that can be absorbed for given geometry and dimensions. The available volume of the container is the useful volume of the container less the actual volume of the plug of absorbing material.

According to the invention, a feeding tube is fitted into the bore, its free end being located inside the latter without touching the plug, and is connected at its other end, tightly with respect to the inside of the container, to a bleeding device intended to work only in gaseous phase and located in the bleeding area of the liquid gas.

By "free end" is meant that end of the feeding tube having one or more bleeding holes for liquid gas in gaseous form. According to the invention, this free end is placed at a certain distance away from the wall of the bore, for instance in the middle of the latter, in order to prevent any direct contact of the bleeding hole (or its edge) with the plug of absorbing material.

According to the invention, it is also essential that the entrance (in the flow direction of the bleeding gas) of the selected bleeding device, which ensures the connection between the inside and the outside of the container, communicates tightly with the end of the feeding tube opposite the free end; "tightly" means here that the junction between the tube and the bleeding device must be tight with respect to the liquid phase of the gas that may be present inside the container in a free state, i.e. outside the absorbing material.

The test report discussed hereafter shows, for different absorbing materials, that the maximum load of liquid phase that can be introduced in the container, according to the invention, without later apparition of liquid phase (during bleeding), can reach a value close to that of the theoretical load $m_1$ calculated as described above.

Without being absolutely certain of the hypotheses set forth, the invention can be explained in the following manner.

(1) The presence of a feeding tube makes it possible to fill the container in such a way that the gas-liquid interface lies level with, and not higher than, the free end of the feeding tube. This corresponds to a certain height h of liquid phase inside the container. When the length l of the tube is at least equal to said height h, no liquid phase bleeds even when turning the container upside down.

(2) Over said height h, the absorbing material will be saturated with liquid phase; depending on the creeping height H of the liquid phase, a gradient of liquid concentration will be obtained over the remaining height of the absorbing material, the value of which will be maximum at the level of the interface, and equal to zero at the height h+H.

(3) Without the feeding tube, the absorbing material would be impregnated with liquid phase only over the height H, anyway when continuous bleeding in gaseous phase is required.

We will now describe the invention with reference to the annexed drawings, among which:

Figure 1:
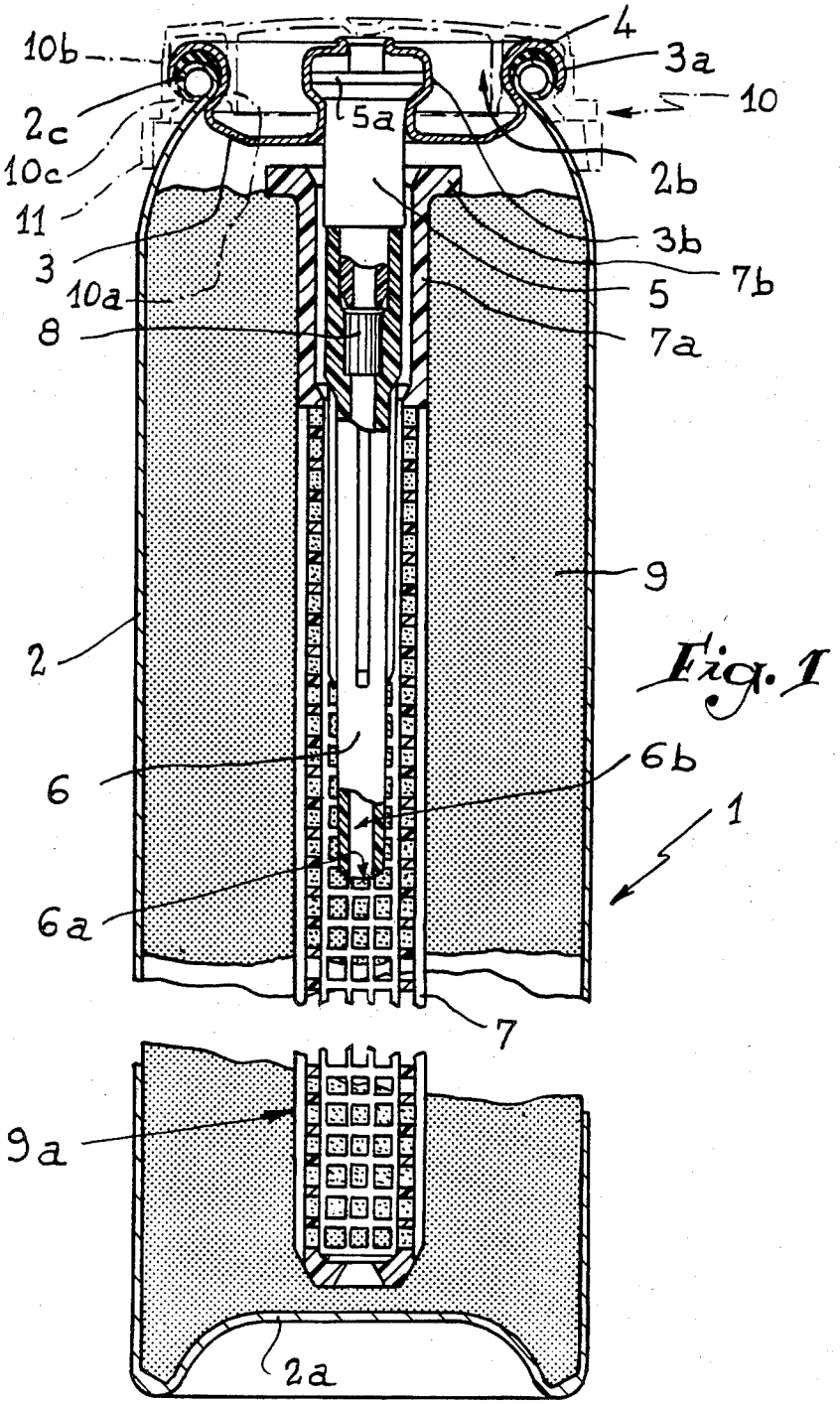
FIG. 1 shows an axial section of a throw-away container of the aerosol generator type or a valve cartridge according to the invention.

The gas cartridge 1 shown in FIG. 1 includes a body 2 made in one piece by drawing or extrusion of an aluminium ingot in the well known manner. The body 2 has a concave bottom 2*a* and a top opening 2*b* with a peripheral rim 2*c*. After filling, the opening 2*b* is closed by means of a cup 3 of which the outer edge 3*a* is crimped over the rim 2*c* of the body 2, a gasket 4 being inserted between these two elements in order to obtain perfect tightness. The middle of the cup 3 is machined in the form of a hollow boss 3b opening downwards, which maintains a valve body 5, by centripetal restraint, below the head 5a of said valve. This valve is tightly connected to a plunger 6 inserted into a perforated chimney 7 extending along the axis of the body 2 and intended to feed gas. A filter 8 is mounted between the valve 5 and the plunger 6, so that the gas bled in the body 1 escapes when wanted through the valve 5, entraining only a very small amount of impurities.

The perforated chimney 7, made of an appropriate synthetic material, surrounds the plunger 6 with some play and forms a separation between an annular plug 9 of absorbing material and said plunger. As a matter of fact, this plug 9 has a central bore 9a extending in such a way that the perforated chimney 7 forms an internal wall inside the plug. It can be seen that the bore 9a extends practically over the whole height of the body 2.

The top part 7a of the perforated chimney 7 surrounds with some play the corresponding part of the plunger 6 and ends in a collar 7b that rests on the top of the plug 9, which stands at a certain distance below the cup 3.

An obturating cap 10 represented in dot-and-dash lines has a central chimney 10a, which interacts with the inside of the peripheral part 3a of the cup 3. The cap 10 also includes an outer skirt 10b with a lower inner rib 10c that engages elastically under the rim 2c of the body 2, in the known manner. The bottom of the skirt 10b is associated by means of a thin junction shoulder with a tear-off guarantee strip that warrants the authenticity of the contents of the cartridge 1 as long as it has not been torn off. It can be seen that some space is left not only between the head of the plunger and the corresponding part of the perforated chimney 7, but also between the tube and said chimney, all along the tube. The length of the tube 6 is such that its free end 6a lies slightly above a theoretical gas-liquid interface depending on the volume of liquid gas introduced into the available volume of the cartridge, whatever be the position of the cartridge 1 in the space.

According to an advantageous example of the invention, the mouth of the feeding plunger lies at mid height of the bore 9a.

Figure 2:
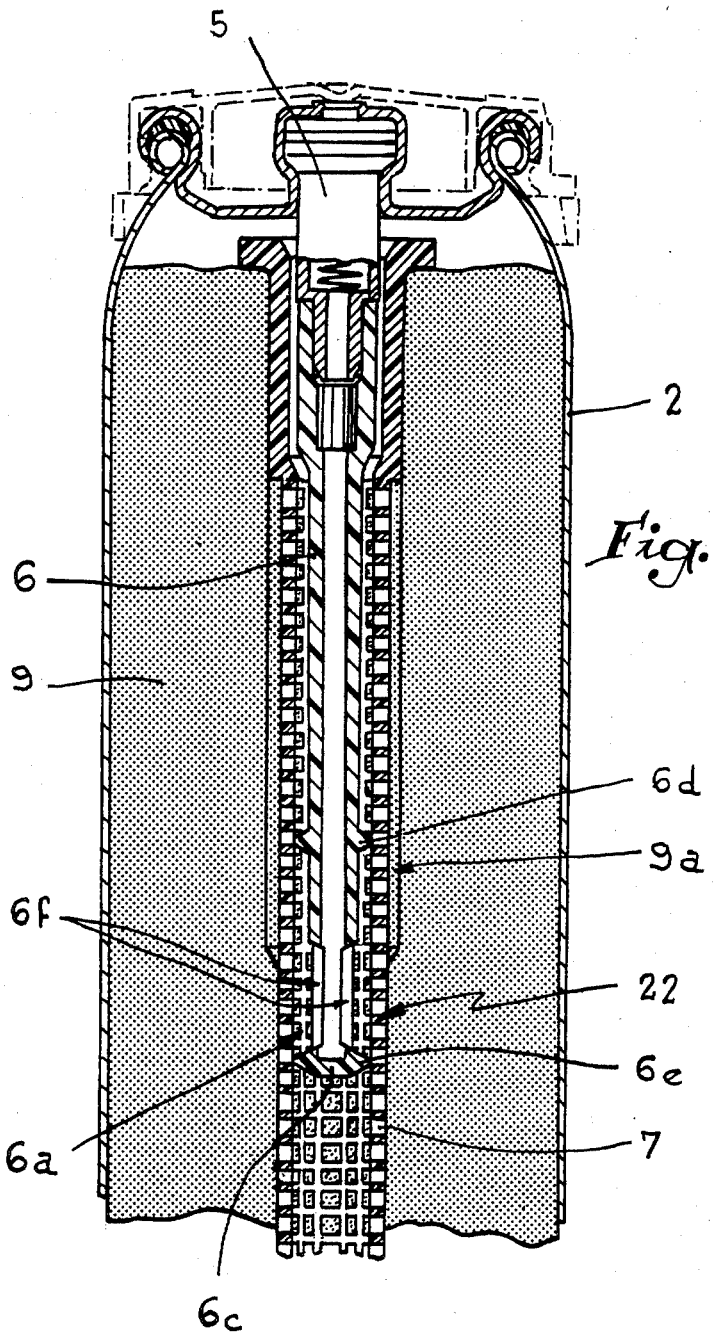
FIG. 2 shows an axial section of a variant of the container represented on FIG. 1.

According to FIG. 2, the feeding tube comprises a single hollow piece with a closed end 6c and presenting two external ring ribs 6d and 6e. These ribs, similar to cross walls and perpendicular to the cartridge axis, form with the wall of the plug 9, and more particularly with the perforated chimney 7, a bleeding chamber 22 that surrounds the free end 6a of the tube.

Both ribs 6d and 6e also form spacing rings between the chimney 7 and the tube 6, preventing the free end of the tube to get in contact with the absorbing material plug 9. The rib 6e located flush with the free end 6a obturates the feeding tube, which has two bleeding holes or ports 6f extending between the two ribs or walls 6d and 6e.

According to the example of FIG. 2, the bleeding holes 6f are protected in their immediate environment against any particles or other dispersed forms of absorbing material that might interpose between the free end of the feeding tube on the one hand, and the absorbing plug on the other hand. Such interference would establish a "bridge" between the tube and the absorbing material, in the same way as a wick bringing unwanted liquid phase toward the tube.

Figure 3:
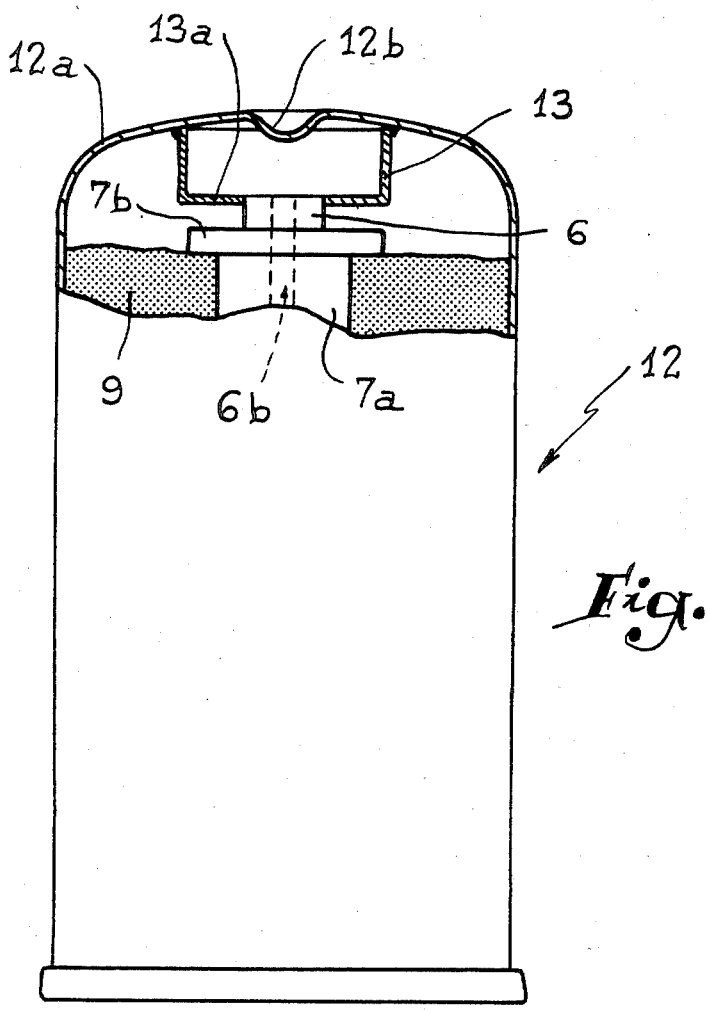
FIG. 3 shows an axial section of another throw-away container, of the pierceable cartridge type, realized according to the invention.

To realize a pierceable cartridge similar to that represented in FIG. 3 by the reference character 12, it is necessary to connect the upper part of the feeding tube 6 to the bottom 13a of a cup 13, the free edges of which are welded or tightly associated in any other manner with the lower face of the dome 12a of the cartridge 12 at the level of the perforated area 12b. In this case, the upper part of the tube 6 must run tightly through the bottom 13a of the cup 13, so that its central canal 6b opens into said cup.

Regarding the absorbing material, different materials have been tested and retained for use according to the invention:

(a) vegetal fibrous materials, such as carded cotton, cotton waste, cellulose fibers among which different types of paper paste, called respectively by the specialists of this industry mechanical paste, unbleached kraft resinous paste, bleached kraft hardwood paste, bisulfite bleached resinous paste, bleached kraft resinous paste, so-called fluff quality bleached paste;

(b) polyurethane foams and more particularly polyether and polyester foams with open cells or not and in different porosity grades.

The absorption rate of commercial butane, i.e. the maximum load M expressed in g that can be introduced in the cartridge without danger of feeding liquid phase when bleeding gas has been assessed according to the following test procedure for a number of cartridges with different shapes or dimensions.

(1) The absorbing material plug has such a shape and such dimensions that it occupies practically the whole internal volume of the container.

(2) Vacuum is applied to the cartridge until an internal pressure of 10 to 20 mm of mercury is obtained.

(3) A load M in liquid phase is introduced into each cartridge.

(4) Each cartridge is then equipped with a bleeding device fitted with a tap and with a rated injector in order to deliver a constant mass flow (for instance 50 g of butane hourly) at the temperature of the experiment.

(5) The so equipped cartridge is placed into a thermostat regulated water bath at 50° C. for 30 minutes.

(6) The cartridge is then removed from the water bath and placed in an air environment at 22° C., the tap is opened and the cartridge held in different positions, head up, lying, or head down; the butane flows in the atmosphere, unburnt.

(7) The time after which liquid phase appears is measured; if it is shorter than 1 minute, the cartridge together with its bleeding device is dipped again into the regulated water bath for another 10 minutes, after which step (6) of the test is repeated; when the time measured is longer than 1 minute, it is assumed that the injected load does not induce any bleeding of liquid phase, because this is generally the case according to the experiments performed.

(8) The occurrence of liquid phase bleeding can be concretely observed by placing a kraft paper sheet at the outlet of the nozzle, at a distance of 1 cm; the colour of the paper changes as soon as droplets, or mist come(s) out.

(9) As soon as the absence of liquid phase is proved according to the preceding steps, the butane load M remaining in the cartridge is measured by weighing.

For different cellulose base fibrous materials such as paper paste, inserted into different valve cartridges according to FIG. 1, and using commercial butane, the results obtained are those shown in the following table; $m_1$ is the theoretical maximum butane load as assessed in the manner indicated in the first part of this description, the volume of the boring being taken into account.

| Tests | Parameters: Height (h) and diameter (d) of the cartridge | Absorbing material and apparent density | Bore length (l) and diameter (D) | Feeding tube, length (L), external and internal diameter ($\phi e$ and $\phi i$) | M in g and in percent of m: Head up | Cartridge lying horizontal | Head down | $m_1$ |
|---|---|---|---|---|---|---|---|---|
| N° 1 | h = 140 mm<br>d = 66 mm | Bleached kraft hardwood paste, 0,10 g/cm$^3$ | l = 130 mm<br>D = 16 mm | L = 58 mm<br>$\phi_e$ = 4 mm<br>$\phi_i$ = 3 mm | 179 g (100%) | 179 g (100%) | 172 g (96%) | 179 g |
| N° 2 | h = 90 mm<br>d = 90 mm | idem | l = 70 mm<br>D = 14 mm | L = 70 mm<br>$\phi_e$ = 4 mm<br>$\phi_i$ = 3 mm | 187 g (100%) | 187 g (100%) | 187 g (100%) | 187 g |
| N° 3 | h = 125 mm<br>d = 40 mm | Bleached kraft hardwood paste, 0,125 g/cm$^3$ | l = 116 mm<br>D = 8 mm | L = 30 mm<br>$\phi_e$ = 4 mm<br>$\phi_i$ = 3 mm | Not measured | Not measured | 58 g (97%) | 60 g |
| N° 4 | h = 125 mm<br>d = 40 mm | Bleached kraft hardwood paste, 0,125 g/cm$^3$ | l = 116 mm<br>D = 8 mm | L = 30 mm<br>$\phi_e$ = 4 mm<br>$\phi_i$ = 3 mm | Not measured | Not measured | 59 g (98%) | 60 g |
| N° 5 | h = 125 mm<br>d = 35 mm | Bleached kraft hardwood paste, 0,125 g/cm$^3$ | l = 116 mm<br>D = 6 mm | L = 40 mm<br>$\phi_e$ = 4 mm<br>$\phi_i$ = 3 mm | 47 g (100%) | 47 g (100%) | 45 g (96%) | 47 g |
| N° 6 | H = 125 mm<br>d = 40 mm | Fluff quality bleached paste, 0,11 g/cm$^3$ | l = 116 mm<br>D = 6 mm | L 40 mm<br>$\phi_e$ = 4 mm<br>$\phi_i$ = 3 mm | 59 g (100%) | 59 g (100%) | 59 g (100%) | 59 g |

By comparing the results of test n° 6 with the values given in the first part of this description, it can be seen that the theoretical absorption capacity of the absorbing material plug can be approached by filling the cartridge to 92% of its capacity without packing. This performance resulting from the invention seems to be quite interesting, since finally the inserted packing reduces the volume available for the storage of the liquid phase only in a very limited manner.

Figure 4:
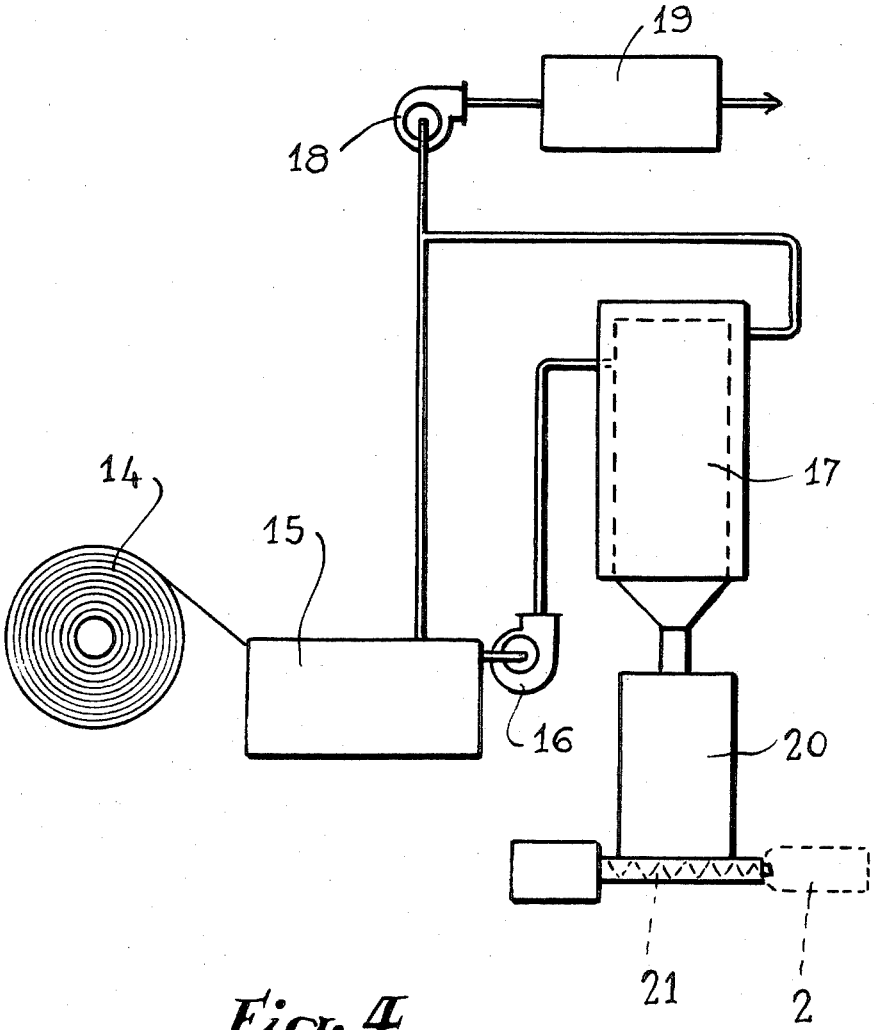
FIG. 4 shows a schematic view of a mass production line of valve cartridges according to FIG. 1.

Mass production of cartridges according to FIG. 1 can be set up using a process that is schematically illustrated in FIG. 4.

Starting from a roll of raw material in the form of a fiber mat 14, the mat is driven through a defibering device 15, beyond which a centrifugal blower 16 conveys the separated fibers into a funnel 17, inside which said fibers are separated from the air. Another blower 18 sucks air into the defibering device 15 and the funnel 17 and expels it outside via a filtration device 19.

The fibers collected in the funnel 17 fall down inside a dosing chute 20, which feeds a wormscrew 21. The fibers are compressed by the rotation of the wormscrew and pushed into the bodies 2 successively placed in alignment with the screw. A core bar (not shown) can be inserted into each of the bodies 2, so that the fed fibers form a crown around the bar, which produces the bore 9*a* and provides for the insertion of the perforated chimney 7 into the bore.

It must be understood that this description is only given as an example and that it does not limit the application field of the invention in any way, the latter covering also any other equivalent solutions used instead of the realization details herein described.

We claim:

1. A container for at least one fluid in both liquid and gaseous phases, the container comprising, in combination:

a hollow body extending along one dimension having an upper wall and a lower wall;

a plug of fluid-absorbing material inserted in the body and substantially filling the body;

the plug defining a central bore which extends substantially through the plug along said dimension, said bore having an open end adjacent to the upper wall of the body and another end adjacent to the lower wall of the body and said bore forming a bleeding area;

a bleeding device having an inlet and an outlet, said bleeding device at least partly extending into the hollow body and cooperating with the upper wall of the body so as to enable said bleeding device to release fluid in its gaseous phase from the bleeding area to the exterior of the body; and a stationary hollow feeding tube centrally positioned inside the bore in spaced relationship with the plug, said tube comprising a central canal area and two open ends, one of said ends being a free end located in the bore and the other end being tightly connected to the inlet of the bleeding device wherein upon charging of the container with fluid the absorbing material plug is saturated with liquid phase throughout a distance between one of the walls of the container and the level of liquid phase in the bore, said distance being less than or equal to the combined length of the feeding tube and the portion of the bleeding device extending into the hollow body and thereby creating a concentration gradient in liquid phase above said level which decreases away from said level so that the gaseous phase of the fluid bleeds from the plug at the bleeding area and is then fed from the bleeding area into the free end of the feeding tube and through the central canal to the bleeding device, the gaseous phase being released to the exterior of the container by the bleeding device without bleeding of the liquid phase, regardless of the position of the container.

2. The container according to claim 1, in which a perforated chimney, having a top collar and a bottom wall, is inserted inside the bore so that the collar rests on the plug and receives, without touching, the feeding tube, the chimney forming an internal wall for the bore.

3. The container according to claim 2, in which two stationary walls directed transversely with respect to the major dimension of the bore form with the internal wall of the bore a bleeding chamber that surrounds the free end of the feeding tube.

4. The container according to claim 3, in which at least one of said transverse walls forms a spacer which is tightly connected to the other end of the feeding tubes.

5. The container according to claim 3, in which one of said transverse walls obturates the free end of the feeding tube, said feeding tube having at least one bleeding port extending between the two transverse walls.

6. The container according to claim 5, in which the feeding tube comprises one hollow part closed at its free end and external ribs forming the transverse walls.

7. The container according to claim 2, in which the volume of the liquid gas contained in the available volume of the container determines a liquid-gas interface lying flush with or just below feeding tube, regardless of the position of the container.

8. The container according to claim 2, in which the free end of the feeding tube lies between the two ends of the bore.

9. The container according to claim 8, in which the free end of the feeding tube opens in a space located at mid-height of the bore.

10. The container according to claim 2, in which the bleeding device comprises a valve having an inlet which is tightly connected to the other end of the feeding tube.

11. The container according to claim 2, in which the bleeding device comprises a tap having an inlet which is tightly connected to the other end of the feeding tubes.

12. The container according to claim 1, in which a first space is left between the plug and the upper wall of said container and a second space is left between the feeding tube and the bore, the two spaces communicating with each other.

13. The container according to claim 1, in which two stationary walls, directed transversely with respect to the major dimension of the bore, form with the inner surface of the bore a bleeding chamber that surrounds the free end of the feeding tube.

14. The container according to claim 13, in which at least one of said transverse walls forms a spacer between the inner surface of the bore and the feeding tube, said transverse wall preventing the free end of the tube from coming in contact with the absorbing material plug.

15. The container according to claim 13, in which one of said transverse walls obturates the free end of the feeding tube, said feeding tube having at least one bleeding port extending between the two transverse walls.

16. The container according to claim 15, in which the feeding tube comprises one hollow part closed at its free end and external ribs forming the transverse walls.

17. The container according to claim 1, in which the volume of the gas in liquid form contained in the available volume of the container determines a liquid-gas interface lying flush with or just below the feeding tube, regardless of the position of said container.

18. The container according to claim 1, in which the free end of the feeding tube and the boring (*9a*) extend vertically and that the free end (*6a*) of the feeding tube opens at a point located between the two ends of the bore.

19. The container according to claim 18, in which the free end of the feeding tube opens in a space located at mid-height of the bore.

20. The container according to claim 1, in which the bleeding device comprises a valve having an inlet which is tightly connected to the other end of the feeding tube.

21. The container according to claim 1 which is disposable, wherein the bleeding device comprises a valve having a head and wherein the upper wall of the body defines an opening, an obturating cup extending into the opening and crimped over the body, the obturating cup having a hollow boss which opens toward the lower wall of the body and receives and attaches to the head of the valve by centripetally restraining and moldingly surrounding the head.

22. The container according to claim 21, wherein the valve includes an inlet which communicates tightly with the other end of the feeding tube.

23. The container according to claim 1, wherein the bleeding device comprises a cup having an outlet top and an inlet bottom wherein said top forms a free edge which fastens tightly to the upper wall of the body and thereby encloses a portion of the upper wall, said portion having a perforatable area and wherein said bottom of the cup is connected tightly to the other end of the feeding tube so that when the perforated area is pierced, gas flows through the feeding tube and into the cup and out of the container.

24. The container according to claim 23 which is disposable.

25. The container according to claim 1, in which the bleeding device comprises a tap having an inlet which is tightly connected to the other end of the feeding tube.

* * * * *

UNITED STATES PATENT AND TRADEMARK OFFICE

CERTIFICATE OF CORRECTION

PATENT NO. : 4,729,494

DATED : March 8, 1988

INVENTOR(S) : Peillon et al.

It is certified that error appears in the above-identified patent and that said Letters Patent is hereby corrected as shown below:

On the title (cover) page of the printed patent, after:

"[30] Foreign Application Priority Data

Apr. 12, 1985 [FR] France . . . . . 85 05747"

add:

--Nov. 25, 1985 [FR] France . . . . . 85 17626--.

Signed and Sealed this

Thirteenth Day of June, 1995

*Attest:*

*Attesting Officer*

BRUCE LEHMAN

*Commissioner of Patents and Trademarks*